US011913287B2

(12) United States Patent
Smith et al.

(10) Patent No.: US 11,913,287 B2
(45) Date of Patent: Feb. 27, 2024

(54) MOUNTING ARRANGEMENT FOR PULLBACK ADAPTOR

(71) Applicant: Vermeer Manufacturing Company, Pella, IA (US)

(72) Inventors: Jacob Richard Smith, Altoona, IA (US); Michael David Langenfeld, Pella, IA (US)

(73) Assignee: Vermeer Manufacturing Company, Pella, IA (US)

( * ) Notice: Subject to any disclaimer, the term of this patent is extended or adjusted under 35 U.S.C. 154(b) by 0 days.

(21) Appl. No.: 17/476,639

(22) Filed: Sep. 16, 2021

(65) Prior Publication Data

US 2023/0079809 A1 Mar. 16, 2023

(51) Int. Cl.
*E21B 10/62* (2006.01)
*E21B 7/04* (2006.01)
*E21B 12/00* (2006.01)

(52) U.S. Cl.
CPC ..... *E21B 10/62* (2013.01); *E21B 7/046* (2013.01); *E21B 12/00* (2013.01)

(58) Field of Classification Search
CPC ..... E21B 10/62; E21B 10/46; E21B 12/00; E21B 7/04
See application file for complete search history.

(56) References Cited

U.S. PATENT DOCUMENTS 8,122,979 B1 2/2012 Wright, Jr. et al.
8,544,569 B2 10/2013 Wright, Jr. et al.
9,169,946 B2 10/2015 Crane et al.
9,611,696 B2 4/2017 Crane et al.
9,719,344 B2 8/2017 Melsheimer
10,208,541 B2 2/2019 Hoelting et al.
10,246,993 B2 4/2019 Melsheimer
2012/0152621 A1* 6/2012 Wright, Jr. ..... E21B 10/62 175/398
2015/0233183 A1* 8/2015 Melsheimer ..... E21B 47/13 175/45

(Continued)

OTHER PUBLICATIONS

Lewis Manufacturing Co., "Lewis Knuckle Joint-1," 2021 Master Catalog (p. 64).

(Continued)

*Primary Examiner* — Caroline N Butcher
(74) *Attorney, Agent, or Firm* — Michael Best and Friedrich LLP

(57) ABSTRACT

A combination of a pullback adaptor and a drill bit includes a pullback adaptor having a first end, a second end, a body extending between the first end and the second end, and a protrusion extending from the body adjacent the second end. The protrusion has a threaded aperture defining an adaptor mounting axis, and the protrusion defines an annular planar mount surface generally perpendicular to the adapter mounting axis. A drill bit has a body with a steering surface, an aperture extending through the body at the steering surface, and an adaptor mount surface adjacent the aperture. The pullback adaptor is mounted to the drill bit with a fastener that extends through the aperture in the drill bit and into the threaded aperture of the pullback adaptor such that the annular planar mount surface of the protrusion engages the mount surface of the drill bit.

20 Claims, 10 Drawing Sheets

(56) References Cited

U.S. PATENT DOCUMENTS

| | | | | |
|---|---|---|---|---|
| 2017/0211337 | A1 | 7/2017 | Woodson | |
| 2022/0412487 | A1* | 12/2022 | McMillan | F16L 21/08 |

OTHER PUBLICATIONS

Lewis Manufacturing Co., "Lewis Knuckle Joint-1" as illustrated in the 2007 Lewis Manufacturing Company Catalog (1 page).
German Patent Office Action for Application No. 102022121440.0 dated Dec. 8, 2023 (5 pages).
Machine Translation of German Patent Office Action for Application No. 102022121440.0 dated Dec. 8, 2023 (6 pages).

* cited by examiner

MOUNTING ARRANGEMENT FOR PULLBACK ADAPTOR

BACKGROUND

The present invention relates to a mounting arrangement for connecting a pullback adaptor to a drill bit used with a horizontal directional drilling (HDD) machine.

HDD machines are used to bore holes through the ground in order to install underground utilities. There is a wide variety in the ground conditions that utilities are installed into, from soft compressible soils to solid rock. The bore holes are formed with a boring tool attached at the front end of a drill string that the HDD machine pushes through the ground. A range of boring tools have been developed enabling the HDD machines to operate efficiently in the various ground conditions.

Utilities are installed by drilling a bore hole that starts at an entry point, where the boring tool and drill string enter the ground. The direction that the bore hole advances is controlled in general by a boring process that includes a first mode where the bore hole advances straight, in-line with the longitudinal axis of the boring tool, or a second mode where the boring tool advances in a direction that deviates from alignment with the longitudinal axis. The first mode involves simultaneous rotation of boring tool and longitudinal advancement. The rotation of the boring tool in this mode is typically continuous. In the second mode the orientation of the boring tool is controlled so that a steering element of the boring tool is positioned in a specific orientation while the boring tool is pushed forward without being rotated continuously. In soft compressible soils the steering element of the boring tool is typically held at a specific orientation, without being rotated. In some soil conditions the steering element of the boring tool may be rotated slightly, such as being oscillated back-and-forth, for instance approximately thirty to forty degrees in both directions from the set orientation. In this mode the boring tool advances forward in a changing direction, the direction deviates from its starting direction. By varying these modes the path of the bore hole can be controlled to an exit point, where the boring tool exits the ground.

The boring tool includes a removable bit having cutting elements to cut through the ground. Boring tools configured for boring through soils typically have a non-symmetrical bit, one having a steering surface of the drill bit that provides the steering element. Boring tools configured for boring through solid rock often times have symmetrical bits, wherein a different component of the boring tool provides the steering element.

This disclosure describes boring tools with drill bits having a steering surface. Due to the wide range of soils, there is a corresponding wide range in the configuration of the steering surfaces of the drill bits.

The process for installing some utilities involves the first step of forming a bore hole as described above, followed by a second step that involves connecting a back reamer in place of the boring tool to enlarge the bore hole. In other cases, the initial bore hole is large enough that it does not need to be enlarged. In those cases, the drill bit can be connected to the product being installed and used to pull that product back through the bore hole while the drill string is being retracted. In some cases, the product being installed can be a gas line, or an electrical cable. In some cases, a conduit is pulled back, and then an electrical cable, or gas line, or fiber optic line is later installed into that conduit. This disclosure will use the term product generically to describe any of these cases.

During the process wherein the drill bit is used to pull-in the product, the boring tool and the drill bit are typically rotated while the drill string is retracted. The product being pulled-in is typically not rotated. A device called a swivel is typically connected to the drill bit and to the product. FIG. 1 illustrates a prior art arrangement with a boring tool 50 connected to swivel 20 having a first end 22 connected to a shackle 30 and a second end 24 connected to a grip device 60. The swivel has a bearing that allows the first end 22 to rotate freely relative to the second end 24.

The grip device 60 is configured to attach to the product 70 that is being installed. There are many different types of grip devices, each configured to connect to a type of product.

The shackle 30 of FIG. 1 is attached to the bit 40 by way of a through hole in the bit, and a bolt that passes through the bit and the shackle. When the boring tool 50 is pulling the product through the bore hole, this system is arranged as shown in FIG. 1 where the swivel is generally parallel to the longitudinal axis 54 of the boring tool and with the product being installed. In this condition the boring tool and drill bit can rotate freely while the product is not rotating.

FIG. 2 illustrates a second embodiment of a prior art mounting arrangement with boring tool 52 connected to swivel 20 with an adaptor 32 configured for being mounted to a drill bit 42 that has a through-hole 44. The swivel, adaptor and drill bit are shown spaced apart in this figure so that the separate components can be identified. A bolt of the adaptor 32 passes through the through-hole 44 of the drill bit 42 to clamp the adaptor 32 against the steering surface of the bit, while the swivel 20 is configured to be connected to the adaptor 32. FIG. 2*a* illustrates these components assembled, and in a misaligned condition. The swivel is intended to be generally parallel to the longitudinal axis 56 of the boring tool 52 during use, when pulling the swivel, oriented as illustrated in FIG. 2.

In some situations as shown in FIGS. 1*a* and 2*a*, when the swivel is attached to the bit with either a shackle or the prior art adaptor, it can rotate to a position where the swivel is not parallel to the longitudinal axis of the boring tool. In this condition any rotation of the boring tool and drill bit will cause the product to rotate. This is undesirable, thus there is a need for a mounting arrangement of a pullback adaptor and swivel that reduces the potential for the swivel to be misaligned with the longitudinal axis of the boring tool.

There is an additional need for a mounting arrangement that can be used with the variety of drill bits to reduce the number of different parts that a user may have to keep in stock. A mounting arrangement having a universal pullback adaptor will allow more consistent operation.

SUMMARY

In one aspect, the disclosure provides a combination of a pullback adaptor and a drill bit. The combination includes a pullback adaptor having a first end configured to connect to a swivel, a second end configured to connect to a drill bit, a body extending between the first end and the second end, and a protrusion extending from the body adjacent the second end. The protrusion has a threaded aperture defining an adaptor mounting axis, and the protrusion defines an annular planar mount surface generally perpendicular to the adapter mounting axis. A drill bit has a body with a steering surface, an aperture extending through the body at the steering surface, and an adaptor mount surface adjacent the aperture. The pullback adaptor is mounted to the drill bit with a fastener that extends through the aperture in the drill bit and into the threaded aperture of the pullback adaptor such that the annular planar mount surface of the protrusion engages the mount surface of the drill bit.

In another aspect the disclosure provides a drill bit configured to be mounted to a pullback adaptor. The drill bit includes a body with a steering surface, and a counterbored aperture extending through the body generally perpendicular to the steering surface. The counterbored aperture includes a larger diameter section at least partially recessed relative to the steering surface to define an adaptor mount surface, and a smaller diameter section extending from the larger diameter section through the drill bit body.

In yet another aspect the disclosure provides a pullback adaptor including a first end configured to connect to a swivel, a second end configured to connect to a drill bit, a body extending between the first end and the second end, and a protrusion extending from the body adjacent the second end. The protrusion has a threaded aperture defining an adaptor mounting axis, and the protrusion defines an annular planar mount surface generally perpendicular to the adapter mounting axis.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
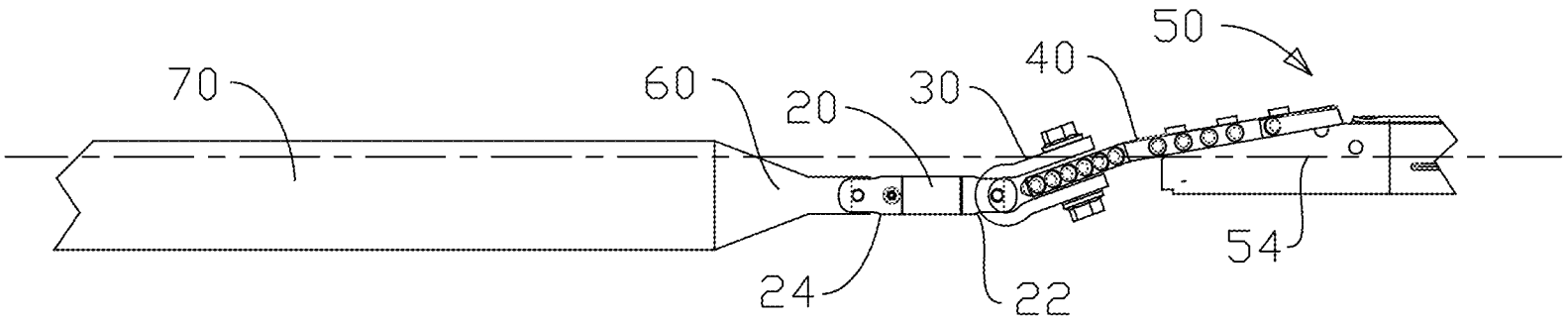
Fig. 1 (Prior Art)
FIG. 1 is a side elevational view of a prior art arrangement of a drill bit, with its steering surface positioned to create a deviation in the vertical plane, connected to a product in a first condition.
Figure 1A:
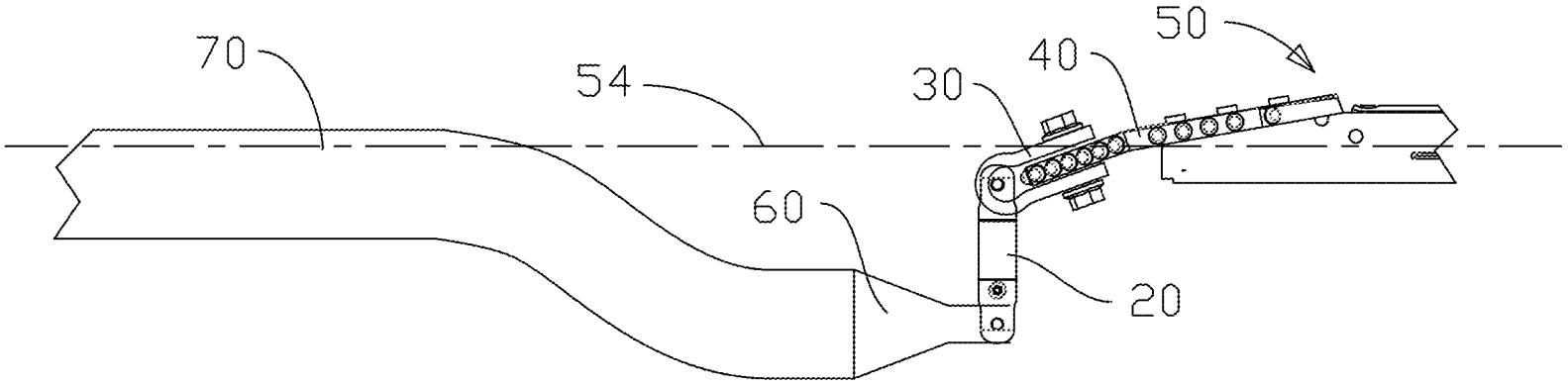
Fig. 1a (Prior Art)
FIG. 1*a* is the side view of the prior art arrangement of FIG. 1 in a second condition.
Figure 2:
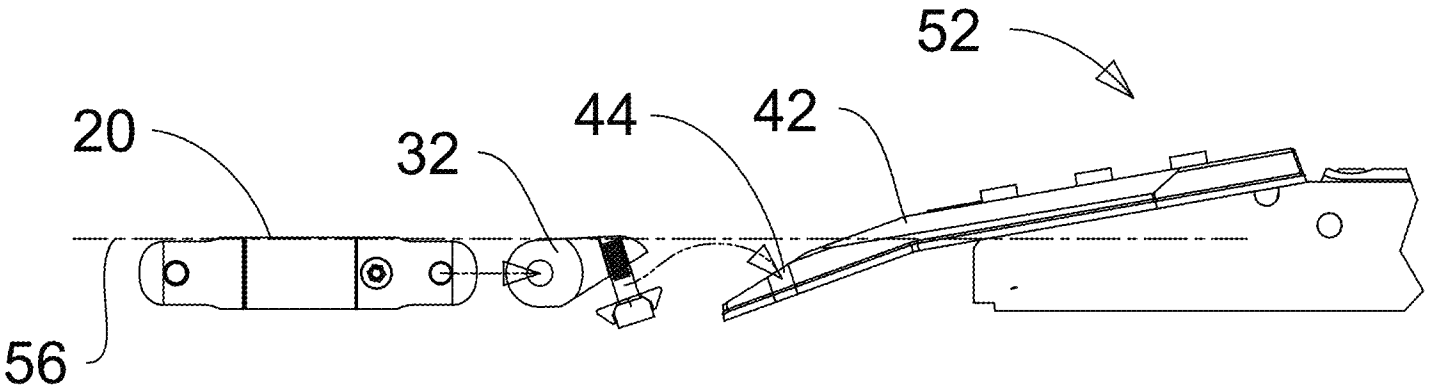
Fig 2 (Prior Art)
FIG. 2 is a side elevational view of a second prior art arrangement of a drill bit, with its steering surface positioned to create a deviation in the vertical plane, connected to a product in a first condition.
Figure 2A:
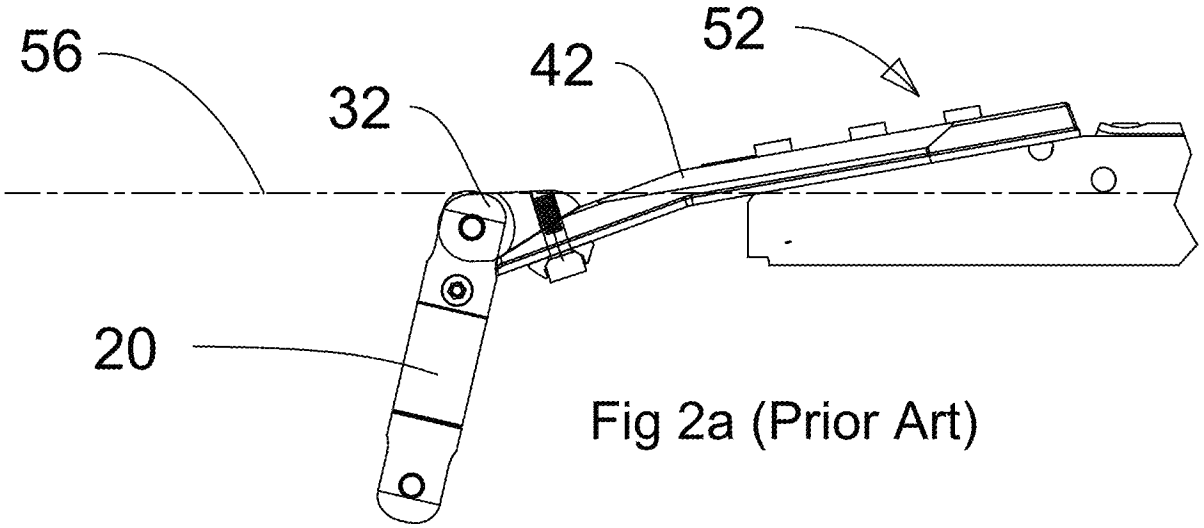
Fig 2a (Prior Art)
FIG. 2*a* is the side view of the second prior art arrangement of FIG. 2 in a second condition.
Figure 3:
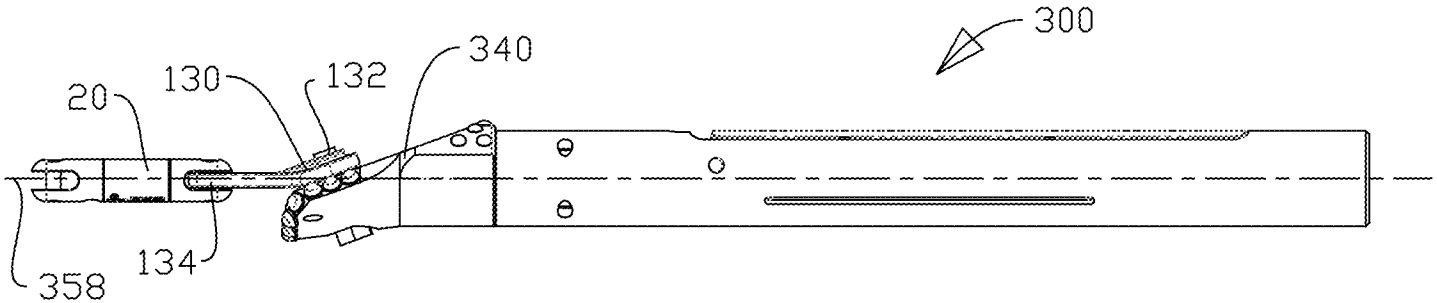
FIG. 3 is a side elevational view of a first embodiment of the mounting arrangement with a drill head having a pullback adaptor connected to a first type of drill bit, with its steering surface positioned to create a deviation in the vertical plane.
Figure 4:
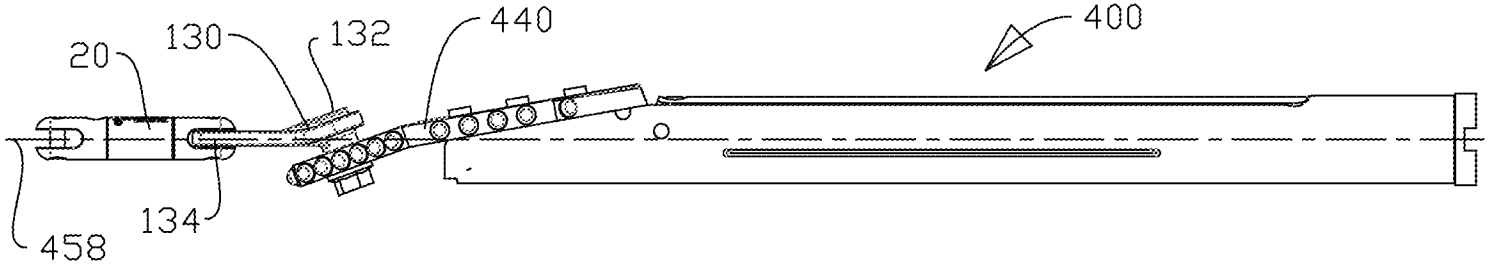
FIG. 4 is a side elevational view of a second embodiment of the mounting arrangement with a drill head having a pullback adaptor connected to a second type of drill bit, with its steering surface positioned to create a deviation in the vertical plane.
Figure 5:
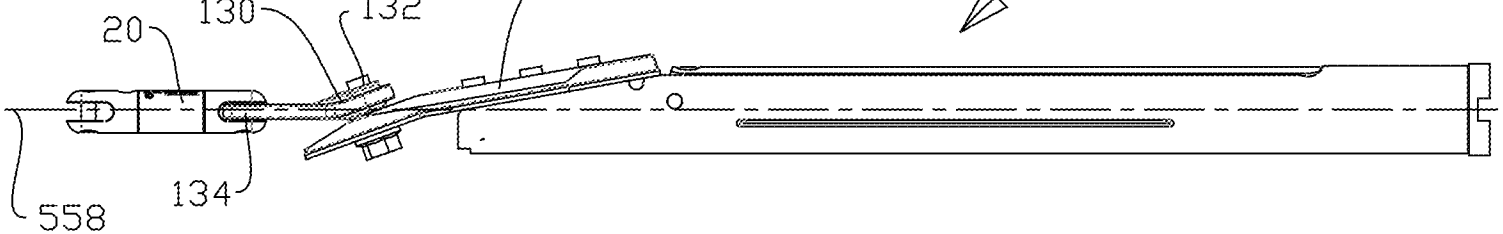
FIG. 5 is a side elevational view of a third embodiment of the mounting arrangement with a drill head having a pullback adaptor connected to a third type of drill bit, with its steering surface positioned to create a deviation in the vertical plane.

FIGS. 3, 4 and 5 are side views of three representative boring tools. The boring tool 300 in FIG. 3 has a bit 340 that is configured for boring in hard soils to soft rock. The boring tool 400 in FIG. 4 has a bit 440 that is configured for boring in hard soils. The boring tool 500 in FIG. 5 has a bit 540 that is configured for boring in softer soils. These figures illustrate a range of different shapes that the boring tools can have. This range is not intended to be representative of all the known shapes, but rather an example of variation.

In each of FIGS. 3, 4 and 5, a pullback adaptor 130 is mounted to the drill bit at a bit mounting end 132 and connected to a swivel 20 at the opposite end, a swivel mounting end 134. The mounting arrangement includes the configuration of the pullback adaptor 130, and the configuration of the drill bit 340, 440 540, which allows the same design of the pullback adaptor 130 to be mounted to these different drill bits. With the illustrated configurations, the swivel 20 in each case is positioned such that the center line of the swivel 20 is generally coaxial with the longitudinal axis of the boring tool: swivel 20 in FIG. 3 is generally coaxial with the longitudinal axis 358 of the boring tool 300, swivel 20 in FIG. 4 is generally coaxial with the longitudinal axis 458 of the boring tool 400, and swivel 20 in FIG. 5 is generally coaxial with the longitudinal axis 558 of the boring tool 500.

Figure 6:
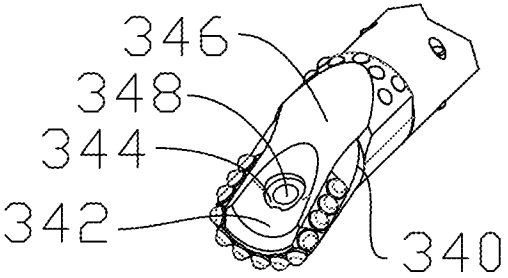
FIG. 6 is an isometric view of the drill bit of the first embodiment.

FIG. 6 illustrates the drill bit 340 of FIG. 3 in more detail, having a first steering surface 342 which is an arcuate, concave surface that improves this bit's ability to cut through some ground conditions having some rock. This bit also has a second steering surface 346. Counterbored aperture 348 is formed in the main body of the bit at the steering surface 342 with a first cylindrical portion or counterbore section, having a first diameter and an axis, extending from the steering surface 342 to an adaptor mount surface 344 that is perpendicular to the axis, and a second cylindrical portion or through-bore section, having a second diameter smaller than the first portion and an axis extending through the bit. The adaptor mount surface 344 is at least partially recessed in the steering surface 342.

Figure 7:
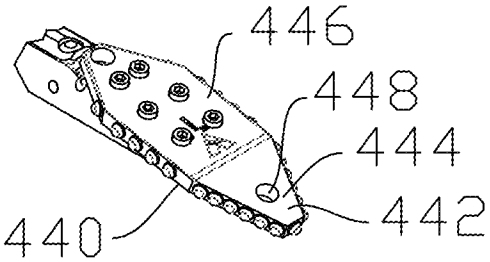
FIG. 7 is an isometric view of the drill bit of the second embodiment.

FIG. 7 illustrates the drill bit 440 of FIG. 4 in more detail, having a first steering surface 442 that is planar and tapers to narrower front end that improves this bit's ability to cut through some ground conditions. This bit also has a second steering surface 446. An adaptor mount surface 444 is on the steering surface 442, adjacent aperture 448 that extends through the bit body from the steering surface 442, through the bit.

Figure 8:
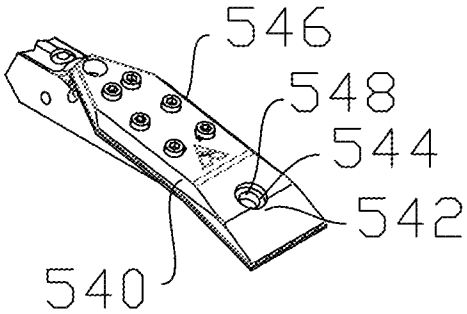
FIG. 8 is an isometric view of the drill bit of the third embodiment.

FIG. 8 illustrates the drill bit 540 of FIG. 5 in more detail, having a first steering surface 542 including two generally planar sections, and extending to a blunt front end to improve this bit's ability to cut through soft ground conditions, and to provide desired steering capability. This bit 540 also has a second steering surface 546. Counterbored aperture 548 is formed though the body of the bit at the first steering surface 542 with a first cylindrical portion or counterbore section, having a first diameter and an axis, extending from the steering surface 542 to an adaptor mount surface 544 that is perpendicular to the axis, and a second cylindrical portion or through-bore section, having a second diameter smaller than the first portion and an axis extending through the bit. The adaptor mount surface 544 is at least partially recessed in the steering surface 542.

Figure 9:
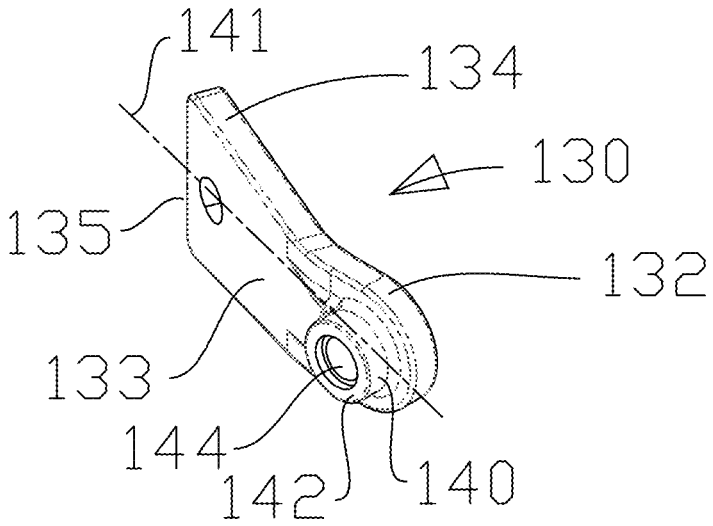
FIG. 9 is an isometric view of the pullback adaptor.
Figure 10:
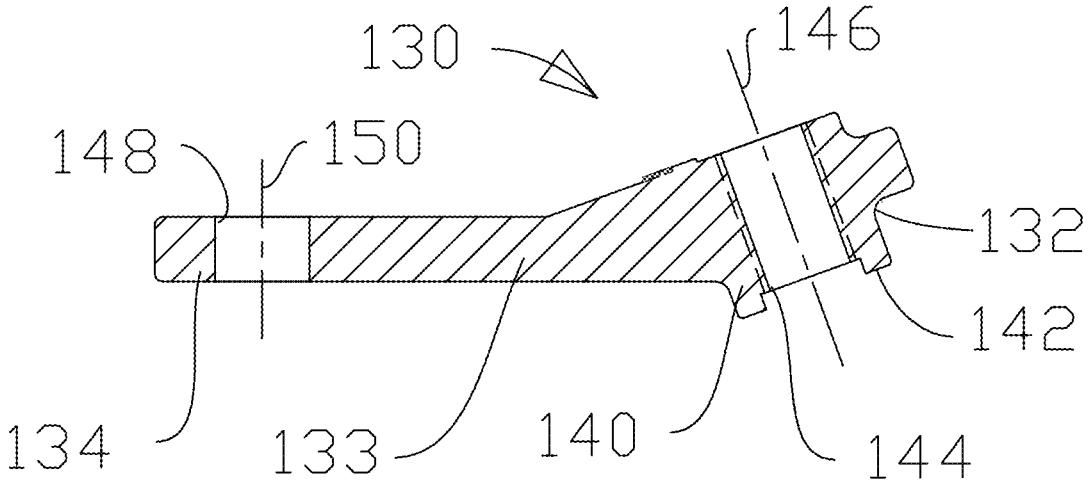
FIG. 10 is a cross-sectional view of the pullback adaptor as shown in FIG. 9.

The pullback adaptor 130 is shown in more detail in FIGS. 9 and 10, having a bit mounting end 132 disposed at one end of main body 133 and a swivel mounting end 134 disposed at the other end of main body 133. The bit mounting end 132 has a cylindrical protrusion 140 terminating at a discoid or annular mount surface 142. A threaded aperture 144 is provided coaxial with the protrusion 140, with an adaptor mounting axis 146. The swivel mounting end 134 has aperture 148 with a swivel mount axis 150 that is disposed in the same plane as the adaptor mounting axis 146. The axes 146 and 150 are angled relative to one another in the same plane. The pullback adaptor 140 has a longitudinal axis 141 extending generally through the threaded aperture 144 and aperture 148 and an abutting end 135 generally perpendicular to the axis 141 at the swivel mounting end 134. The abutting end 135 is configured with a width sufficient to prevent a swivel with common dimensions, when properly connected with a fastener, from rotating about aperture 148 through more than 15 degrees in either direction.

Figure 11:
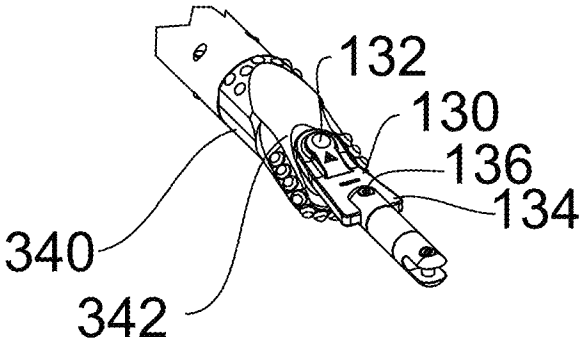
FIG. 11 is an isometric view of the first embodiment with a drill head having the pullback adaptor connected to the first type of drill bit with the mounting arrangement.
Figure 12:
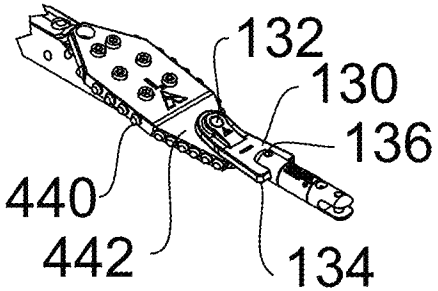
FIG. 12 is an isometric view of the second embodiment with a drill head having the pullback adaptor connected to the second type of drill bit with the mounting arrangement.
Figure 13:
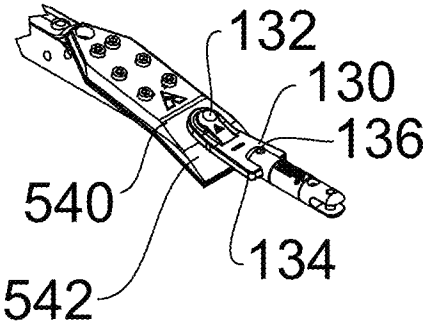
FIG. 13 is an isometric view of the third embodiment with a drill head having a pullback adaptor connected to the third type of drill bit with the mounting arrangement.

FIGS. 11, 12 and 13 illustrate boring tools having the pullback adaptor 130 and swivel 20 mounted thereon. FIG. 11 shows the pullback adaptor 130 mounted to drill bit 340 at its steering surface 342. FIG. 12 shows the pullback adaptor 130 mounted to drill bit 440 at its steering surface 442. FIG. 13 shows the pullback adaptor 130 mounted to drill bit 540 at its steering surface 542. In each of these embodiments, the pullback adaptor 130 of the same configuration is used, being mounted to the drill bit, with the bit mounting end 132, that terminates at an arcuate edge, in a manner illustrated in FIGS. 14, 15 and 16, as is described below. The pullback adaptor 130 includes a swivel mounting end 134 configured significantly wider than the width of the swivel 20 and that terminates at a linear edge. The swivel mounting end 134 of the pullback adapter 130 also has a width greater than the bit mounting end 132 of the pullback adaptor 130 such that the body of the pullback adapter 130 tapers in width between the ends 132, 134. With this configuration the swivel 20 is not able to rotate significantly about the mounting fastener 136 that connects the swivel 20 to the pullback adaptor 130, in order to maintain the alignment of the swivel 20 with the pullback adaptor 130.

Figure 14:
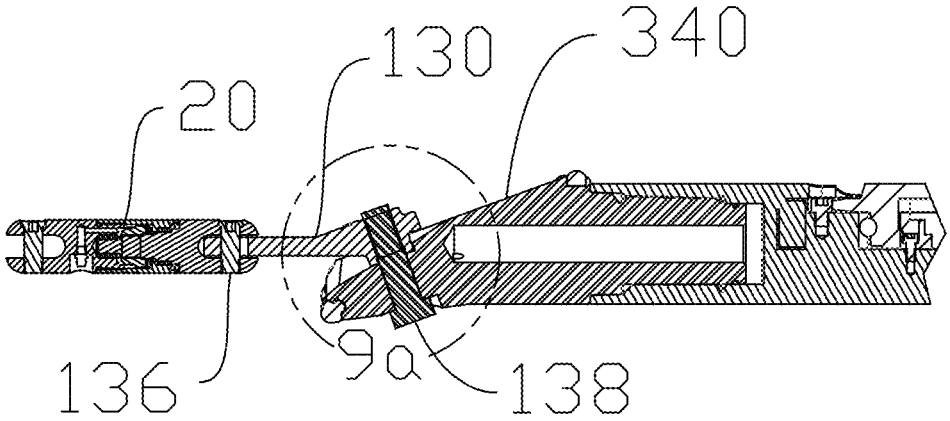
FIG. 14 is a cross-sectional view in the vertical plane of the first embodiment with a drill head, as shown in FIG. 3 and passing through the longitudinal axis, having the pullback adaptor connected to the first type of drill bit with the mounting arrangement.
Figure 14A:
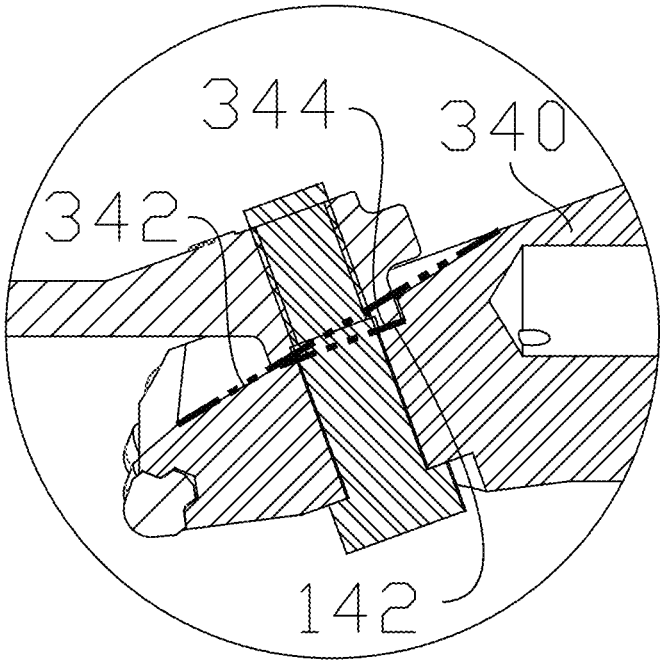
FIG. 14*a* is an enlarged view of a portion of the cross-sectional view of FIG. 14 showing the mounting arrangement.

FIG. 14 illustrates the pullback adaptor 130 mounted to drill bit 340 with bolt 138 that passes through the aperture 348 of the drill bit and into the threaded aperture 144 of the pullback adaptor 130. Swivel 20 is mounted to the pullback adaptor 130 with fastener 136. In FIG. 14*a*, the mount surface 142 of the pullback adaptor 130 is shown in contact with and engaging the mount surface 344 of the bit 340. The protrusion 140 of the pullback adaptor is sized to fit into the first portion or counterbore section of the counter bored aperture 348 of the drill bit 340.

Figure 15:
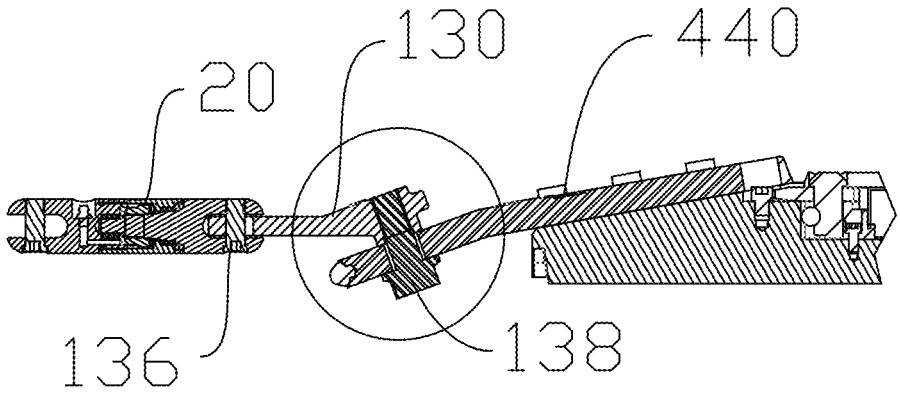
FIG. 15 is a cross-sectional view in the vertical plane of the second embodiment with a drill head, as shown in FIG. 4 and passing through the longitudinal axis, having the pullback adaptor connected to the second type of drill bit with the mounting arrangement.
Figure 15A:
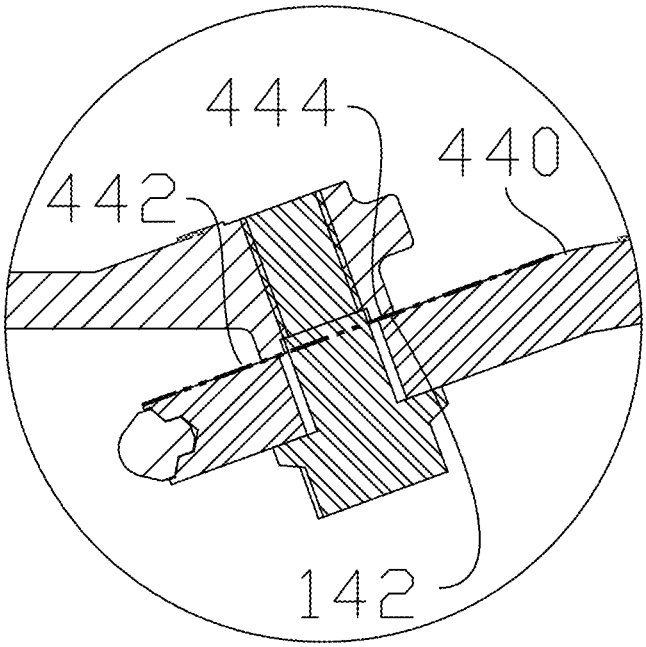
FIG. 15*a* is an enlarged view of a portion of the cross-sectional view of FIG. 15 showing the mounting arrangement.

FIG. 15 illustrates the pullback adaptor 130 mounted to drill bit 440 with bolt 138 that passes through the aperture 548 of the drill bit 540 and into the threaded aperture 144 of the pullback adaptor 130. Swivel 120 is mounted to the pullback adaptor 130 with fastener 136. In FIG. 15*a*, the mount surface 142 of the pullback adaptor 130 is shown in contact with and engaging the mount surface 444 of the bit 440.

Figure 16:
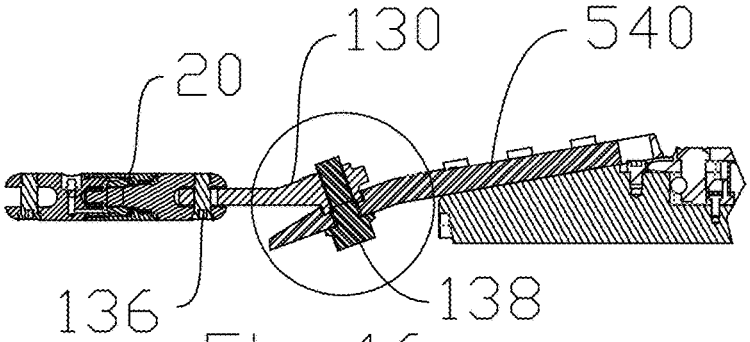
FIG. 16 is a cross-sectional view in the vertical plane of the third embodiment with a drill head, as shown in FIG. 5 and passing through the longitudinal axis, having the pullback adaptor connected to the third type of drill bit with the mounting arrangement.
Figure 16A:
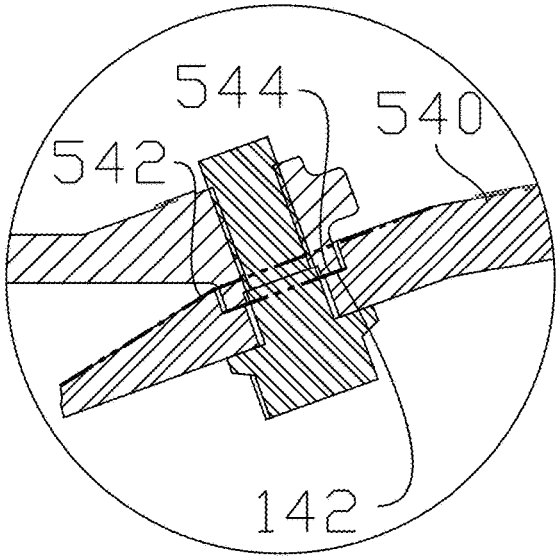
FIG. 16*a* is an enlarged view of a portion of the cross-sectional view of FIG. 16 showing the mounting arrangement.
Figure 16B:
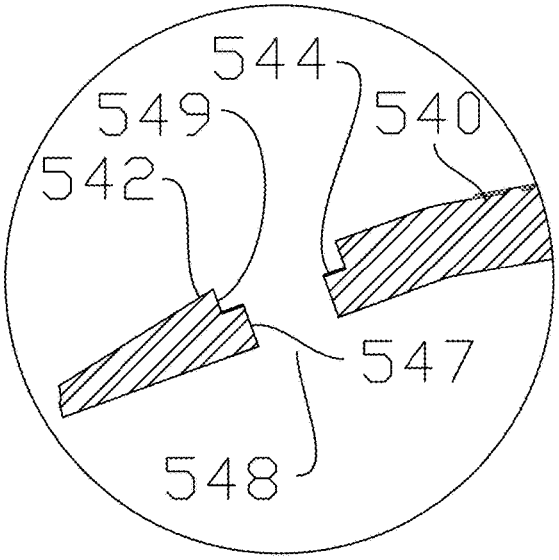
FIG. 16*b* is the same view as FIG. 16*a*, but without the pullback adaptor.

FIG. 16 illustrates the pullback adaptor 130 mounted to drill bit 540 with bolt 138 that passes through the smaller diameter portion 547 or through-bore section of aperture 548 of the drill bit 540 and into the threaded aperture 144 of the pullback adaptor 130. Swivel 20 is mounted to the pullback adaptor 130 with fastener 136. In FIG. 16*a* the mount surface 142 of the pullback adaptor 130 is shown in contact with and engaging the mount surface 544 of the bit 540. The protrusion 140 of the pullback adaptor 130 is sized to fit into the larger diameter portion 549 or counterbore section of the counter bored aperture 548 of the drill bit 540, as is illustrated more clearly in FIG. 16*b*.

Figure 17:
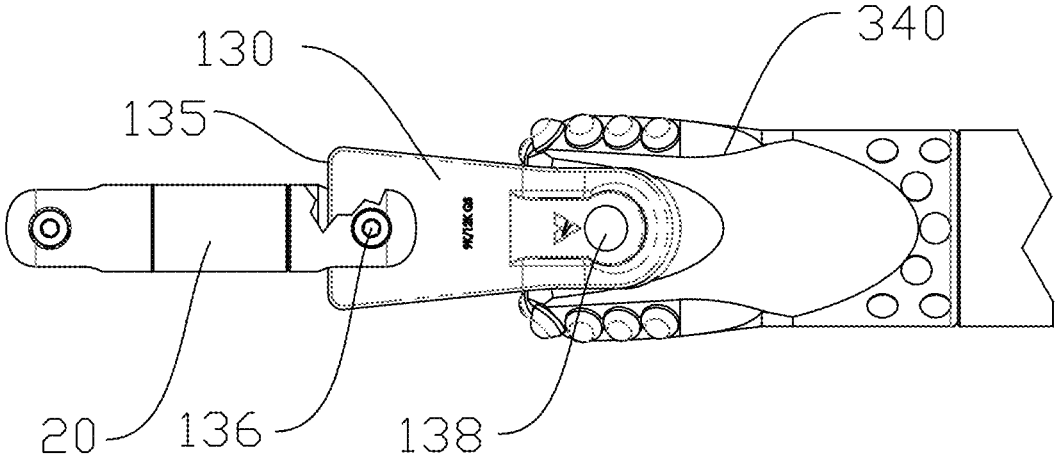
FIG. 17 is a top view of the first embodiment with a drill head, as shown in FIG. 3, having the pullback adaptor connected to the first type of drill bit with the mounting arrangement with the pullback adaptor and the swivel aligned with the longitudinal axis of the boring tool.
Figure 17A:
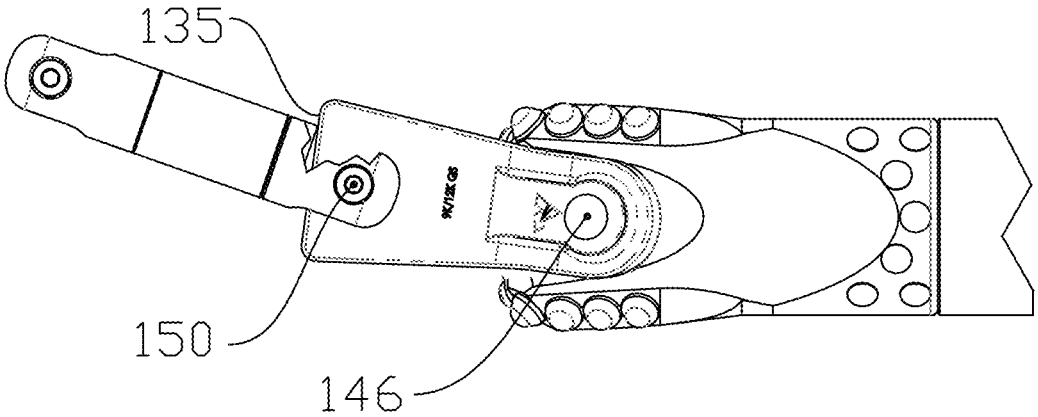
FIG. 17*a* is the top view of FIG. 17, but with the pullback adaptor mis-aligned with the drill bit, and the swivel mis-aligned with the pullback adaptor.

FIG. 17 illustrates the boring tool of the first embodiment with a swivel 20 of common dimensions mounted to pullback adaptor 130 with fastener 136 and the pullback adaptor 130 mounted to drill bit 340 with fastener 138. A portion of the swivel 20 is broken-away to illustrate the clevis end of the swivel 20. The swivel 20 and the pullback adaptor 130 are aligned with the longitudinal axis of the boring tool, in the preferred condition illustrated in this figure. FIG. 17*a* illustrates the boring tool, pullback adaptor 130 and a swivel 20 of common dimensions, with the pullback adaptor 130 in a position where it is misaligned with the boring tool to the maximum amount possible, wherein the clevis end of the swivel 20 is in contact with the abutting end 135 of the pullback adaptor 130. Since the adaptor mounting axis 146 and the swivel mount axis 150 are disposed in the same plane, misalignment can only occur in a plane illustrated in this figure. The pullback adaptor 130 is restrained from pivoting to a more misaligned position since it fits into the concave steering surface 342. In the position shown, the pullback adaptor 130 is contacting the steering surface 342, and it cannot pivot past that position.

The swivel 20 is restrained from pivoting to a more misaligned position since the abutting end 135 of the adaptor 130 is wider than the clevis end of the swivel 20. In the position shown, the swivel 20 is in contact with the end 135 of the adaptor 130, and it cannot pivot past that position. In this condition the axis of the swivel 20 is close enough to being in alignment with the axis of the boring tool that the drill bit can rotate without causing rotation of the product being installed.

Various features are set forth in the following claims.

What is claimed is:

1. A combination of a pullback adaptor and a drill bit, the combination comprising:

a pullback adaptor having a first end configured to connect to a swivel;

a second end configured to connect to a drill bit;

a body extending between the first end and the second end; and a protrusion extending from the body adjacent the second end, the protrusion having therein a threaded aperture defining an adaptor mounting axis, the protrusion defining an annular planar mount surface generally perpendicular to the adapter mounting axis;

a drill bit having a body with a steering surface;

an aperture extending through the body at the steering surface; and an adaptor mount surface adjacent the aperture;

wherein the pullback adaptor is mounted to the drill bit with a fastener that extends through the aperture in the drill bit and into the threaded aperture of the pullback adaptor such that the annular planar mount surface of the protrusion engages the mount surface of the drill bit.

2. The combination of claim 1, further comprising a counterbore coaxial with the aperture extending through the body of the drill bit, the counterbore defining the adaptor mount surface.

3. The combination of claim 2, wherein the adaptor mount surface is at least partially recessed in the steering surface.

4. The combination of claim 1, wherein the first end of the pullback adapter includes an aperture defining a swivel mount axis, the swivel mount axis and the adapter mounting axis both lying in a first plane.

5. The combination of claim 4, wherein in the first plane, the swivel mount axis and the adapter mounting axis are angled relative to one another.

6. The combination of claim 1, wherein the aperture extending through the body at the steering surface extends generally perpendicular to the steering surface.

7. The combination of claim 1, wherein the first end of the pullback adapter has a width greater than the second end of the pullback adaptor.

8. The combination of claim 7, wherein the body of the pullback adapter tapers in width between the first and second ends.

9. The combination of claim 1, wherein the first end of the pullback adapter terminates at a linear edge and the second end of the pullback adapter terminates at an arcuate edge.

10. The combination of claim 9, wherein the linear edge of the first end is sized and configured to limit pivotal movement between the pullback adapter and a connected swivel.

11. A pullback adaptor comprising:

a first end configured to connect to a swivel;

a second end configured to connect to a drill bit;

a body extending between the first end and the second end; and a protrusion integrally formed with and extending from the body adjacent the second end, the protrusion having therein a threaded aperture defining an adaptor mounting axis, the protrusion defining an annular planar mount surface generally perpendicular to the adapter mounting axis.

12. The pullback adaptor of claim 11, wherein the first end includes an aperture defining a swivel mount axis, the swivel mount axis and the adapter mounting axis both lying in a first plane.

13. The pullback adaptor of claim 12, wherein in the first plane, the swivel mount axis and the adapter mounting axis are angled relative to one another.

14. The pullback adaptor of claim 11, wherein the first end has a width greater than the second end.

15. The pullback adaptor of claim 14, wherein the body tapers in width between the first and second ends.

16. The pullback adaptor of claim 11, wherein the first end terminates at a linear edge and the second end terminates at an arcuate edge.

17. The pullback adapter of claim 11, wherein the aperture extends entirely through the protrusion.

18. A pullback adaptor comprising:

a first end configured to connect to a swivel;

a second end configured to connect to a drill bit;

a body extending between the first end and the second end; and a protrusion extending from the body adj acent the second end, the protrusion having therein a threaded aperture defining an adaptor mounting axis, the protrusion defining an annular planar mount surface generally perpendicular to the adapter mounting axis;

wherein the first end includes an aperture defining a swivel mount axis, the swivel mount axis and the adapter mounting axis both lying in a first plane.

19. The pullback adaptor of claim 18, wherein in the first plane, the swivel mount axis and the adapter mounting axis are angled relative to one another.

20. The pullback adapter of claim 18, wherein the aperture extends entirely through the protrusion.

* * * * *